United States Patent [19]

Harrison

[11] Patent Number: 4,554,172

[45] Date of Patent: Nov. 19, 1985

[54] METHOD OF REPAIRING ELECTRODE SURFACES

[75] Inventor: Charles H. Harrison, Cleveland, Tenn.

[73] Assignee: Olin Corporation, Cheshire, Conn.

[21] Appl. No.: 628,087

[22] Filed: Jul. 5, 1984

[51] Int. Cl.[4] ..... B32B 35/00; B29H 19/00

[52] U.S. Cl. ..... 427/12; 427/58; 427/142; 427/385.5; 156/94

[58] Field of Search ..... 204/290 R, 290 F; 427/58, 385.5, 12, 140, 142; 156/94

[56] References Cited

U.S. PATENT DOCUMENTS 3,254,282 5/1966 West ..... 427/79

3,922,226 11/1975 Entwisle ..... 204/290 F

FOREIGN PATENT DOCUMENTS 2107737 5/1983 United Kingdom .

*Primary Examiner*—Richard Bueker

*Attorney, Agent, or Firm*—James B. Haglind; Donald F. Clements

[57] ABSTRACT

A method of repairing a damaged electrode surface comprises coating the damaged area with a polyhaloolefin. The coated area is cured, for example, by heat or radiation and the cured coating bonds the damaged area to the surrounding electrode surface.

The method of the invention permits the "in situ" repair of electrode surfaces while preventing distortion of the electrode surface or its support members.

10 Claims, No Drawings

METHOD OF REPAIRING ELECTRODE SURFACES

This invention relates to electrodes employed in electrolytic cells for aqueous solutions of ionic substances. More specifically, the invention relates to the repair of minor damages to electrodes employed in electrolytic cells.

Modern commercial electrolytic cells used, for example, in the production of chlorine and alkali metal hydroxides, employ metal electrodes which are coated with electrochemically active materials. It is economically advantageous in certain types of these cells, such as membrane electrolytic cells, to place the electrodes as close to the membrane separator as possible to minimize electric power usage. Preferably one or both of the electrodes is placed in direct contact with the membrane separator. Where this is the case, it is necessary to provide electrode surfaces which are smooth and flat. The electrode flatness required is generally about $\pm 1$ mm or less.

Damage in the form of dents, tears or cracks can readily occur to electrode surfaces, for example, while in transit or during their installation in the electrolytic cell. Where the area damaged is large, the electrode surface is replaced or repaired, for example, by welding the separated areas. However, where the area damaged is small, it is uneconomical to replace the electrode surface and, repairing areas having metal separation by methods such as welding results in distortion of the electrode surface and/or the electrode frame or support members.

Now it has been found that damages to electrode surfaces such as dents or metal separations including tears and cracks can be readily repaired without replacement of the electrode surface or distortion of the electrode surface or its support members.

It is an object of the present invention to provide a method for repairing damaged areas of electrode surfaces without distortion to the electrode surface or support members.

Another object of the present invention is to provide a method of repair for damaged areas of electrode surfaces to be used in situ.

An additional object of the present invention is to provide a method of repair for damaged areas of electrode surfaces which minimizes the time period required for repairs.

These and other objects of the invention are accomplished in a method of repairing a damaged electrode surface which comprises coating the damaged area with a polyhaloolefin and curing the coating, the cured coating bonding the damaged area to the surrounding electrode surface.

More in detail, the electrode surfaces repaired by the method of the present invention are those which are employed in commercial cells, for example, for the production of chlorine and alkali metal hydroxides by the electrolysis of alkali metal chloride brines. Typically, where the electrode surfaces serve as the anode, a valve metal such as titanium or tantalum is used. The valve metal has a thin coating over at least part of its surface of a platinum group metal, platinum group metal oxide, an alloy of a platinum group metal or a mixture thereof. The term "platinum group metal" as used in the specification means an element of the group consisting of ruthenium, rhodium, palladium, osmium, iridium, and platinum.

The anode surfaces may be in various forms, for example, a screen, mesh, woven wire cloth, perforated plate, or an expanded vertical mesh which is flattened or unflattened, and having slits horizontally, vertically, or angularly.

A preferred anode surface is a foraminous metal mesh having good electrical conductivity in the vertical direction along the anode surface.

As the cathode, the electrode surface is suitably a metal screen or mesh where the metal is, for example, iron, steel, nickel, or tantalum. If desired, at least a portion of the cathode surface may be coated with a catalytic coating to reduce the hydrogen overvoltage. Suitable catalytic coatings include Raney nickel or Raney nickel alloys or a platinum group metal, alloy or oxide, as defined above.

Where a limited area of the electrode surface has been damaged, for example, up to about 20 percent of the electrode surface area, by denting or tearing of the metal, the damaged area is cleaned, if necessary. Any dirt or oils present are removed by known cleaning methods including washing with an organic solvent such as acetone, or carbon tetrachloride, an acid such as sulfuric or hydrochloric, or an alkaline agent such as sodium hydroxide. The damaged area is then coated with a polyhaloolefin which is substantially resistant to chemical attack by electrolytes or gases present in the electrolytic cell. The electrolytes employed include, for example, alkali metal halides and/or alkali metal hydroxides at concentrations normally used in electrolytic processes while the gases present in the cell may include halogens such as chlorine or bromine as well as hydrogen and oxygen.

The polyhaloolefin may be applied to the electrode surface in any suitable manner including, for example, spraying or brushing.

Suitable polyhaloolefins include polymers of lower olefins having 2 to 3 carbon atoms which are substituted by at least one fluorine or chlorine atom. The olefin may be substituted by other elements such as hydrogen. Examples of polyhaloolefins which can suitably be used include polytetrafluoroethylene (PTFE), polyvinyl fluoride (PVF), polyvinylidene fluoride (PVDF), polychlorotrifluoroethylene (PCTFE), polyvinyl chloride (PVC), polyvinylidene chloride (PVDC), chlorinated polyvinylchloride (C-PVC), fluorinated ethylene-propylene copolymer (FEP), ethylene-chlorotrifluoroethylene copolymer (E-CTFE), ethylene-tetrafluoroethylene copolymer (ETFE), perfluoroalkoxy resin (PFA) and TEFLON EPE. Preferred embodiments of polyhaloolefins are polyfluoroolefins selected from the group consisting of polytetrafluoroethylene, fluorinated ethylene-propylene copolymer, ethylene-chlorotrifluoroethylene copolymer, polyvinylidene fluoride and ethylene-tetrafluoroethylene copolymer.

Suitable amounts of polyhaloolefin are applied to the damaged area to provide a smooth surface which is flat and free of burrs or sharp edges which might damage the separator upon contact with the electrode surface. Where the mesh is torn, the coating forms a bond between the damaged area and the surrounding areas of the electrode surface.

Curing of the polyhaloolefin coating may be accomplished by applying heat or radiation. Sources of heat include hot air, a hot liquid such as water or brine, steam or dielectric heating. Radiation curing can employ infrared, X-ray or gamma rays. As the coated areas are small, it is preferred to use a portable heat gun as a source of heat for curing. This permits the coating to be cured in place which reduces the time required for repairing the electrode surface; and at low temperatures below about 350° C. for example, from about 150° to about 250° C. which prevents distortion by heat of the electrode surface or its support members.

In a preferred embodiment, the polyhaloolefin coating is applied in layers, with each succeeding layer being separately cured.

The novel method of the present invention permits the "in situ" repair of damaged electrodes in a manner which is efficient, economic and without damage to the electrode surface or its support members.

The invention is further illustrated by the following examples without any intention of being limited thereby.

EXAMPLE

A titanium mesh anode had a "U" shaped damaged area in which the mesh was indented and cut, forming sharp edges. The damaged area was made level and the sharp edges bent slightly inward. The damaged area was cleaned with acetone. A layer of polyvinylidene fluoride (PVDF) emulsion was applied by brush to the damaged area and cured with a heat gun. The application was repeated until a smooth coat of PVDF was formed which covered the damaged area and bonded the damaged area to the surrounding mesh. The repaired electrode was installed as an anode in a membrane electrolytic cell for the electrolysis of sodium chloride brine to produce chlorine and sodium hydroxide. The electrode was placed in direct contact with the cation exchange membrane. Following 60 days of operation, the repaired area of the electrode was examined and found to be sound, showing no signs of separation from the surrounding mesh.

What is claimed is:

1. A method of repairing physically damaged electrode surfaces of an electrolytic cell electrode having a membrane separator in contact with the electrode surface which comprises coating the damaged area with a polyhaloolefin and curing said coating, said cured coating bonding a repaired damaged area to the surrounding electrode surface.

2. The method of claim 1 in which the polyhaloolefin is selected from the group consisting of polymers of olefins having 2 to 3 carbon atoms which are substituted by at least one fluorine or chlorine atom.

3. The method of claim 2 in which said curing is accomplished by the application of heat.

4. The method of claim 2 in which said curing is accomplished by the application of radiation.

5. The method of claim 2 in which said polyhaloolefin is selected from the group consisting of polytetrafluoroethylene, polyvinyl fluoride, polyvinylidene fluoride, polychlorotrifluoroethylene, polyvinyl chloride, polyvinylidene chloride, chlorinated polyvinylchloride, fluorinated ethylene-propylene copolymer, ethylene-chlorotrifluoroethylene copolymer, ethylene-tetrafluoroethylene copolymer, and perfluoroalkoxy resin.

6. The method of claim 3 in which the curing temperature is from about 150° to about 250° C.

7. The method of claim 2 in which at least two layers of the polyhaloolefin are applied where each layer is cured before the application of an additional layer.

8. The method of claim 2 in which the damaged area comprises up to 20 percent of the electrode surface area.

9. The method of claim 1 in which said physically damaged electrode surfaces include those having dents, tears, cracks, and separations.

10. A method of repairing damaged electrode surfaces of a membrane electrolytic cell electrodes which comprises:

(a) cleaning said damaged area;

(b) applying a first layer of a polyhaloolefin to said damaged area;

(c) curing said first layer of polyhaloolefin;

(d) applying a second layer of said polyhaloolefin to said first layer; and (e) curing said second layer, said first and second layers forming a coating which bonds the repaired damaged area to the surrounding electrode surface.

* * * * *